US005093962A

United States Patent [19]

Farrington et al.

[11] Patent Number: 5,093,962

[45] Date of Patent: Mar. 10, 1992

[54] METHOD OF FORMING WEBS WITHOUT CONFINING DUCTS

[75] Inventors: Allan P. Farrington, Princeton; Gerald M. Marshall, Somerville; Theodore J. Krainski, Old Bridge, all of N.J.

[73] Assignee: Chicopee, New Brunswick, N.J.

[21] Appl. No.: 568,565

[22] Filed: Aug. 16, 1990

Related U.S. Application Data

[63] Continuation-in-part of Ser. No. 75,708, Jul. 20, 1987.

[51] Int. Cl.[5] ..... D01G 25/00; B27N 3/04

[52] U.S. Cl. ..... 19/296; 156/62.2

[58] Field of Search ..... 19/156.3, 256, 302, 19/105; 264/121, 511, 518, 107, 112, 113, 116; 57/400, 408; 28/105; 156/62.8, 62.2, 62.4; 425/82.1, 80.1, 81.1, 83.1

[56] References Cited

U.S. PATENT DOCUMENTS

| | | | |
|---|---|---|---|
| 3,010,161 | 11/1961 | Duvall | 264/121 X |
| 3,645,814 | 2/1972 | Knoepfler et al. | 156/62.8 |
| 3,755,856 | 9/1973 | Banks | 19/302 X |
| 3,894,315 | 7/1975 | Fukuta et al. | 19/296 X |
| 3,918,126 | 11/1975 | Wood | 19/156.3 |
| 4,280,253 | 7/1981 | Holt | 19/296 |
| 4,788,817 | 12/1988 | Artzt et al. | 57/408 X |
| 4,815,170 | 3/1989 | Estruch Portell | 19/105 |

FOREIGN PATENT DOCUMENTS 2192010 12/1987 United Kingdom ..... 57/400

OTHER PUBLICATIONS

*Cotton Manufacturing Pt. 1* E. A. Posselt, p. 142.

*Cotton, Pickers, Cards, Drawing Rolls, Combers, Fly Frames* International Library of Technology, p. 14, Seat 18.

*Primary Examiner*—Werner H. Schroeder

*Assistant Examiner*—John J. Calvert

*Attorney, Agent, or Firm*—Joseph F. Shirtz

[57] ABSTRACT

A cylinder, for example a lickerin, and feed mechanism create a supply of individual fibers, for example pulp, which follow the rotation of the lickerin. These fibers are deflected from the lickerin in the form of a stream by means of a plate arranged parallel to the lickerin. A conveying screens intercepts the stream of fibers and accumulates them into a web without the use of a high pressure stream of air to doff the fibers from the lickerin or to capture fibers on the conveyor. Further, the housing for the apparatus is opened so that there are no seals to compress the web after it is produced. A feed tray located next to the lickerin can be used to include other particulate materials (fiber or granules) in the main fiber stream and a tapering of the deflector plate can separate the component of the blended fiber-particulate material stream into layers in the resulting web distinguished by particle weight.

12 Claims, 4 Drawing Sheets

METHOD OF FORMING WEBS WITHOUT CONFINING DUCTS

This is a continuation-in-part application of copending application Ser. No. 75,708, filed July 20, 1987.

TECHNICAL FIELD

The present invention relates to methods and apparatus for forming non-woven structures of fibers and, more particularly, to the efficient formation of uniform webs from fiber materials, such as pulp board stock or fiber batts.

BACKGROUND ART

Non-woven fabrics are structures consisting of accumulations of fibers typically in the form of a web. Such fabrics have found great use in disposable items, such as hand towels, table napkins, curtains, hospital caps, draperies, etc., because they are far less expensive to make than conventional textile fabrics made by weaving and knitting processes.

There exist many different processes for forming non-woven structures. The processes, however, when used to generate uniform pulp fluff structures from pulp board stock, generally involve introducing the individualized pulp fibers into an air stream, such that the fibers are conveyed at high velocity and high dilution rates to a moving condensing screen upon which the fibers are accumulated in the form of a continuous web. The individualized pulp fibers may be generated through the use of various hammer mills. As an alternative, the fibers may be generated by using a lickerin or wire-wound roll to grind or shred pulp board. An air stream is tangentially passed over the fiber-laden lickerin, or about the mill, to doff or remove the fibers and entrain them in the air stream. Typically the air stream with the fibers is contained within a duct from the point of grinding to the point of deposition upon the condenser screen. In order to maintain the air streams in the duct at velocities high enough to ensure a uniform flow and deposition of the fibers upon the condensing screen, as well as to assure that the fibers do not adhere to the duct walls, it is necessary to employ a fan or other suction device beneath the condensing screen to create a pressure of at least 20 inches of water, and often up to 100 inches of water.

U.S. Pat. No. 3,512,218 of Langdon discloses apparatus for forming non-woven webs with two lickerins. The fibers are doffed from the lickerins by a single air stream formed by a suction box below the condensing screen. U.S. Pat. No. 3,535,187 of Woods discloses a similar arrangement wherein two air streams are used to doff the fibers from the lickerin. According to U.S. Pat. No. 3,772,739 of Lovgren both pulp fibers and longer textile fibers are individualized and blended in apparatus using high speed lickerins rotating at different speeds. As in the other references, the individualized fibers are doffed from their respective lickerins by separate air streams produced by a suction fan located in the condenser section of the apparatus. A baffle plate inserted between two lickerins for controlling the degree of mixing of fibers doffed by air streams passing over separate lickerins is described in U.S. Pat. No. 3,768,118 of Ruffo et al. and U.S. Pat. No. 3,740,797 of Farrington.

In these references, and generally in the prior art, the high speed air streams impel the fibers against the moving condenser screen at such a speed that there is a compression of the resulting web. In addition, the particles, after leaving the lickerin or rotating cylinder, are conducted to the condensing screen by a duct structure which confines their travel and, due to the air pressure, accelerates their travel. In order to assure that the air pressure is not reduced, seal means are provided where the duct structure engages the moving condenser screen. This may be in the form of floating or rolling seals, which further act to compress the fiber web as it is withdrawn from the condenser on the moving screen.

Because of the substantial pressure which must be generated in order to create the high speed air streams, the prior art methods of producing non-woven webs require a great deal of energy. In addition, the resulting web is compressed both by the air stream and the seals that are used to maintain the pressure for the air stream. Thus it would clearly be advantageous to the production of fluff fiber structures, or staple length fiber structures, if they could be created with much less energy and with less compression, i.e. much greater loft.

DISCLOSURE OF THE INVENTION

The present invention is directed to a method and apparatus for (1) forming high loft fiber structures without the use of high speed air streams and duct structure, such that much less energy is needed and a more lofty web is formed, and (2) blending other fibers or particulate matter into the fiber structure.

In an illustrative embodiment of the invention, a frame structure is used which has an endless conveyor screen in its lower section. This screen enters the frame structure at one end and exits it at the other. At the locations where the conveyor screen enters and leaves the frame, the frame is open to the atmosphere.

At an upper portion of the frame there is a feeding means for feeding fiber stock, e.g. pulp stock, rayon or cotton, into engagement with a high speed rotating cylinder, i.e. lickerin. The feeding means essentially comprises a feed roller, which forces the stock against the lickerin, and a nose bar that holds the stock in place as its end is shredded by the wire projections of the lickerin or other rough objects on the surface of a cylinder.

It has been found that in the absence of a high speed air stream, the individualized fibers created by the rotating cylinder tend to follow the peripheral direction of the cylinder. However, if a deflector plate is positioned parallel to the axis of the cylinder, but closely spaced from its peripheral surface, the fibers are directed from the cylinder in a stream toward the conveyor screen located in the lower portion of the frame.

At the conveyor screen, the individual particles are accumulated into a non-woven fiber structure. As the screen is moved, a continuous fiber structure is formed, which structure extends out of the open end of the frame to other processing equipment.

If desired, a relatively low air pressure may be created in a suction chamber below the screen. This acts to keep dust particles at a minimum and to improve the lateral placement of the fibers in forming the web. However, this low pressure is insufficient to doff the individual fibers from the lickerin. In particular, the suction pressures can be less than 5 inches of water, and are preferably in the range of ½ to 1 inch of water, as opposed to 20 to 100 inches of water as in prior art processes.

Pulp webs formed by this new process are typically more lofty than webs formed using a conventional process because of the lower compression effect resulting from the elimination of the high velocity depositing stream and the absence of seals positioned at the exit of the conveyor screen from the frame.

Other materials can be blended with the fibrous stream deflected from the cylinder. This is accomplished by mounting a feed tray beneath and parallel to the nose bar. The rotation of the cylinder creates a high velocity airstream in proximity to the rotating surface which draws particulate or fibrous materials in a tray toward the cylinder, where it is blended with the fiber stream. This results in the creation of unique blended non-woven fiber products.

When two materials of different densities are combined through the use of a feed tray, it is also possible to control the relative positioning of the two components in the resulting fiber structure by varying the shape of the discharge edge of the deflector plate. A sharp-edged, straight plate will yield a uniformly blended web. However, a discharge edge that is angled or curved away from the normal direction of flow, will create a wall attachment effect that causes light weight particles to follow the contour of the wall, while heavy particles, under inertial influence, continue in a straight line. The result is a preponderance of heavy particles in the lower layers of the fiber structure, and light particles in the upper layers.

BRIEF DESCRIPTION OF THE DRAWINGS

The foregoing and other features of the present invention will be more readily apparent from the following detailed description and drawings of illustrative embodiments of the invention which.

DESCRIPTION OF AN ILLUSTRATIVE EMBODIMENT

Description of an embodiment using short fiber pulp stock and a rotating lickerin will now be given. However, the invention will operate on long fibers using a rotating cylinder (i.e. card).

Figure 1:
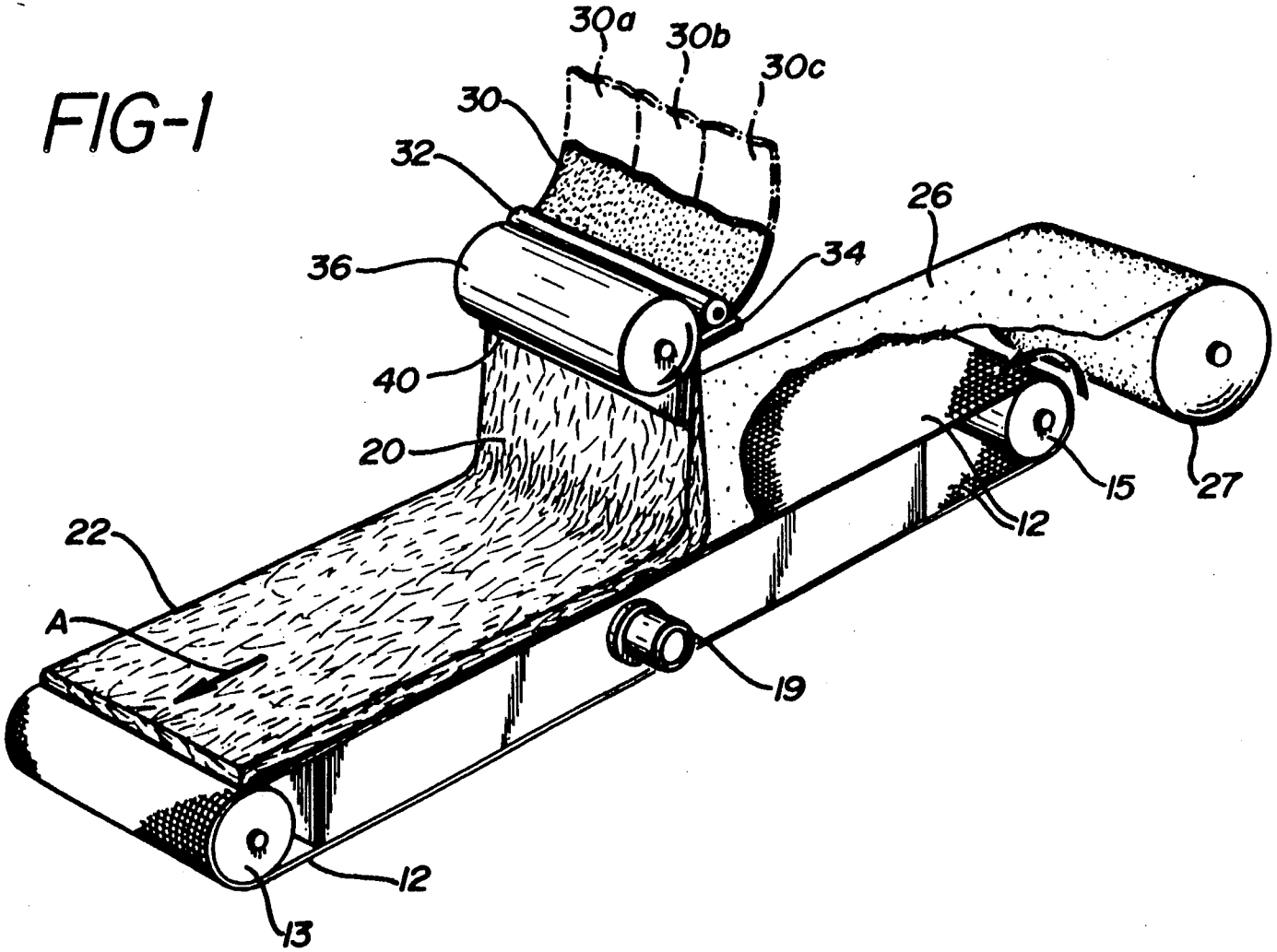
FIG. 1 is a schematic illustration of apparatus for carrying out the present invention, but with the frame removed.

In FIG. 1 there is shown the lower portion of a frame structure for carrying out the present invention. This structure includes a low vacuum chamber 10 which creates vacuum forces on a conveyor mesh screen 12. This screen is moved by a motor (not shown) such that it travels from the right of FIG. 1 to the left, as shown by arrow A. Because the screen 12 is continuous, it passes about a roller 13, under the vacuum chamber 10, over a roller 15 and back into the frame of the apparatus over the top of vacuum chamber 10. The perforations in conveyor screen 12 allow suction force which is less than 5 inches of water, and preferably in the range of ½ to 1 inch of water, to be created across the screen where the screen is over openings in the vacuum chamber 10. This low vacuum is created in chamber 10 by suction in a conduit 19, shown extending from a side of the housing. The conveyor screen 12 intersects stream 20 of individualized short fibers, e.g. pulp fibers, and accumulates them to form the non-woven structure or web of material 20.

One of the desirable features of this device is that it allows the non-woven structure 22 to be formed on a porous substrate 26. This substrate 26 may be tissue paper or a similar porous thin web material. It may be fed from a roll 27 and carried into the frame by screen 12. Such a substrate will generally have a uniform width that is the same or greater than that of the formed web 22. However, in FIG. 1, the substrate 26 is shown partially broken away to reveal the screen 12.

The raw material for creating the fibers is typically derived from pulp board stock 30. Such pulp boards come in varying thicknesses and lengths and are a ready source of "short fibers". The terms "short fibers" typically refers to paper making fibers, such as wood pulp fibers or cotton linters, having a length less than about ¼ inch. These fibers are generally inexpensive and absorbent, and thus are greatly used for making non-woven products. In addition to pulp boards, short fibers may be obtained from various types of wood, asbestos, glass fibers and the like.

Figure 2:
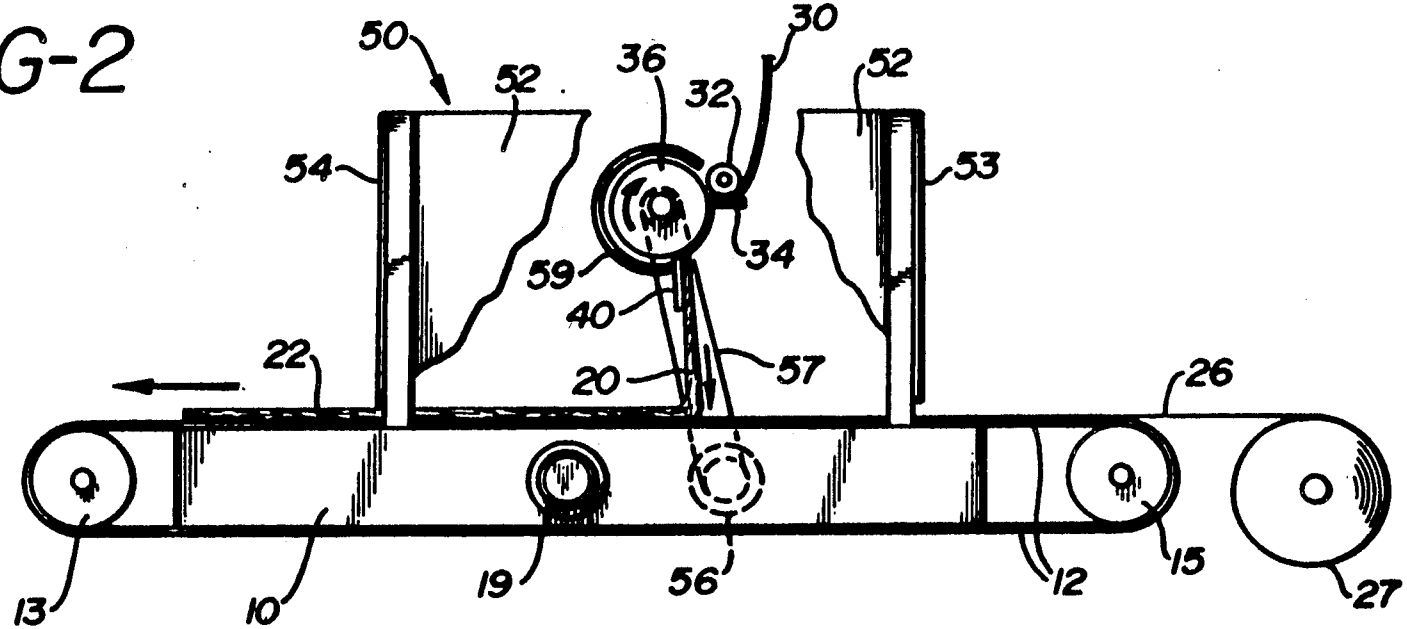
FIG. 2 is a schematic illustration of a side view, partially broken away, of apparatus for practicing the present invention, including the frame thereof.

Individual short fibers are created in the example of FIGS. 1 and 2, from the pulp board 30 by means of feed roller 32, nose bar 34 and lickerin 36. In particular, the feed roller 32 is rotated by motors (not shown) to drive the pulp board 30 against the wire projections of lickerin 36. Because the pulp board is flexible, it must be held rigid at its end such that the projections of the lickerin can open or separate the fibers from the board. This is accomplished by the nose bar 34.

The speed of the feed roller 32 controls the rate at which the pulp board is fed against the lickerin, and thus affects the thickness of the web which is formed at any particular speed for the conveyor screen 12. The spacing of the nose bar from the feed roller and the lickerin is optimized for the particular pulp board 30 being utilized, such that it can be assured that complete separation of the fibers is accomplished. In addition, the speed of the lickerin is set to optimize the fiberization process. For example, a 9 inch diameter lickerin may be rotated at from about 4,000 to 6,000 r.p.m.

As the fibers are separated from board 30 they become entrained in an air stream created by the high speed rotation of lickerin 36. As a result, the fibers tend to follow the contour of the periphery of the lickerin. In order to doff these fibers from the lickerin, a deflector plate 40 is positioned at a particular location along the peripheral direction of rotation of lickerin 36. The effect of this deflector plate is to separate the stream of individual fibers from the lickerin and to direct it onto the conveyor screen. The deflector plate is not in contact with the lickerin. However, it is believed that it acts to separate the fibers from the lickerin by deflecting the air stream created by the lickerin rotation toward the conveyor screen, so that the fibers, which are entrained in this air stream, follow the air stream onto the conveyor.

In FIG. 2, a frame 50 for the apparatus is illustrated. The frame has no top, but it has side plates 52 which are shown broken away so that the interior of the structure can be seen. These side plates 52 act to support feed roll 32, nose bar 34 and lickerin 36.

The end plates 54 and 55 at the exit and entrance to the apparatus, respectively, stop at some distance above the conveyor screen 12. Thus, the interior of the frame is open to the atmosphere and cannot be under a high vacuum. Further, the end walls 54, 55 do not contain any sealing rollers or floating seals to maintain a vacuum. The absence of such a seal at end plate 54, assures that the natural loft of the web created by the present invention is not compressed.

As shown in FIG. 2, a motor 56 is connected to a belt 57 and acts to turn the lickerin at the proper speed for optimum individualization of the fibers.

A device according to the present invention is capable of forming uniform low density pulp webs at speeds in excess of 300 linear feet per minute. At a speed of 300 feet per minute webs of weights of up to 2 ounces per square yard can be achieved. At slower speeds, the apparatus can produce webs in excess of 20 ounces per square yard.

In a preferred embodiment, a cover 59 extends from the deflector plate 40 to the feed roll 32 on the side of the lickerin away from the fiber stream 20. This additionally acts to prevent the air stream from completely circling the lickerin and carrying individual fibers beyond the deflector plate 40.

Figure 3:
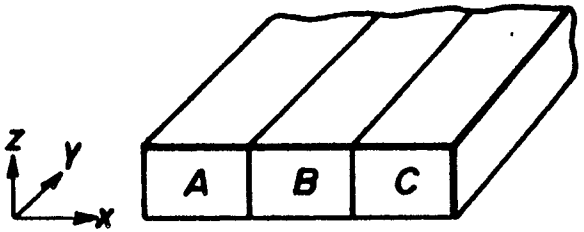
FIG. 3 is a perspective view of one end of a product made according to the embodiment of FIG. 1.

While typically a single fibers board 30 would be fed to the lickerin, it is also possible to feed simultaneously separate boards 30*a*, 30*b* and 30*c* (FIG. 1) to the apparatus. Further, it is possible to form unitary boards having three different segments. These segments 30*a*, 30*b*, 30*c* may be distinguished by a difference in composition or merely a difference in color. When such an arrangement is used, the cross-sectional composition of the web produced is as shown in FIG. 3. In particular, there will be three separate lateral zones in the X direction of FIG. 3 forming the web material. The web is continuous in the longitudinal or Y direction and can be severed as desired to produce products of a particular length. The height of the product (i.e. in the Z direction) depends on the speed of the conveyor (greater height for a slower speed) and the speed of the feed roller 32 (greater height for a faster speed).

Products produced by the present invention have more loft than conventional products. It is believed that this results because a greater proportion of the individual pulp fibers are deposited in the present invention such that their axes are generally perpendicular to the conveyor screen, than in prior high vacuum type systems. This results in more resiliency in the web perpendicular to the screen (i.e. in the Z direction) and a product that has better fluid uptake. When a strong suction force is used below the screen, the fibers tend to flatten out, which removes the resiliency perpendicular to the screen and the natural channels for conducting fluids across the thickness of the web.

In conventional dual rotor machines, such as that described in U.S. Pat. No. 3,740,797 of Farrington, when a 40 inch long lickerin is used there is a loss of between 8 and 12 pounds of pulp per hour due to the high suction. With the present invention, however, there is only about ⅓ of a pound per hour lost. Thus, there is less material which is wasted and less clean up is required in the vicinity of the machine.

In a ductless device according to the present invention, the stream of material has a greater fiber to air ratio than in a machine like that of the Farrington patent. However, fibers are deposited at a slower velocity. These two effects tend to cancel each other so that the ductless webber has the same throughput as a conventional webber. Also, in the conventional webber there tends to be an overlapping of fibers, which creates a shingle effect in the machine or conveyor screen direction. This may cause the web to separate. However, this shingle effect is absent from products produced according to the present invention.

It may be desirable to blend other materials in the non-woven structure created by the apparatus of the present invention. This can be accomplished by installing an open feed tray 60 beneath the nose bar 34 as shown in FIG. 4.

Individualized short fibers, e.g. from a hammer mill, or other fine particulate materials, e.g. superabsorbent powders, are placed in or metered into the tray. The high velocity air stream created in proximity to the lickerin surface due to its rotation, draws the fine particulate material (e.g either fibers or granules) in the tray toward the lickerin. The material is drawn to the lickerin because the high speed rotation of the lickerin creates a low static pressure zone at its periphery.

At the lickerin, the particles from the feed tray blend with the fibers following the lickerin and create a generally uniform blend of fibers and particles. This blend is deflected from the lickerin as a blended fiber stream by the deflector plate 40. The result is a blended product such as that shown in FIG. 6A.

Figure 4:
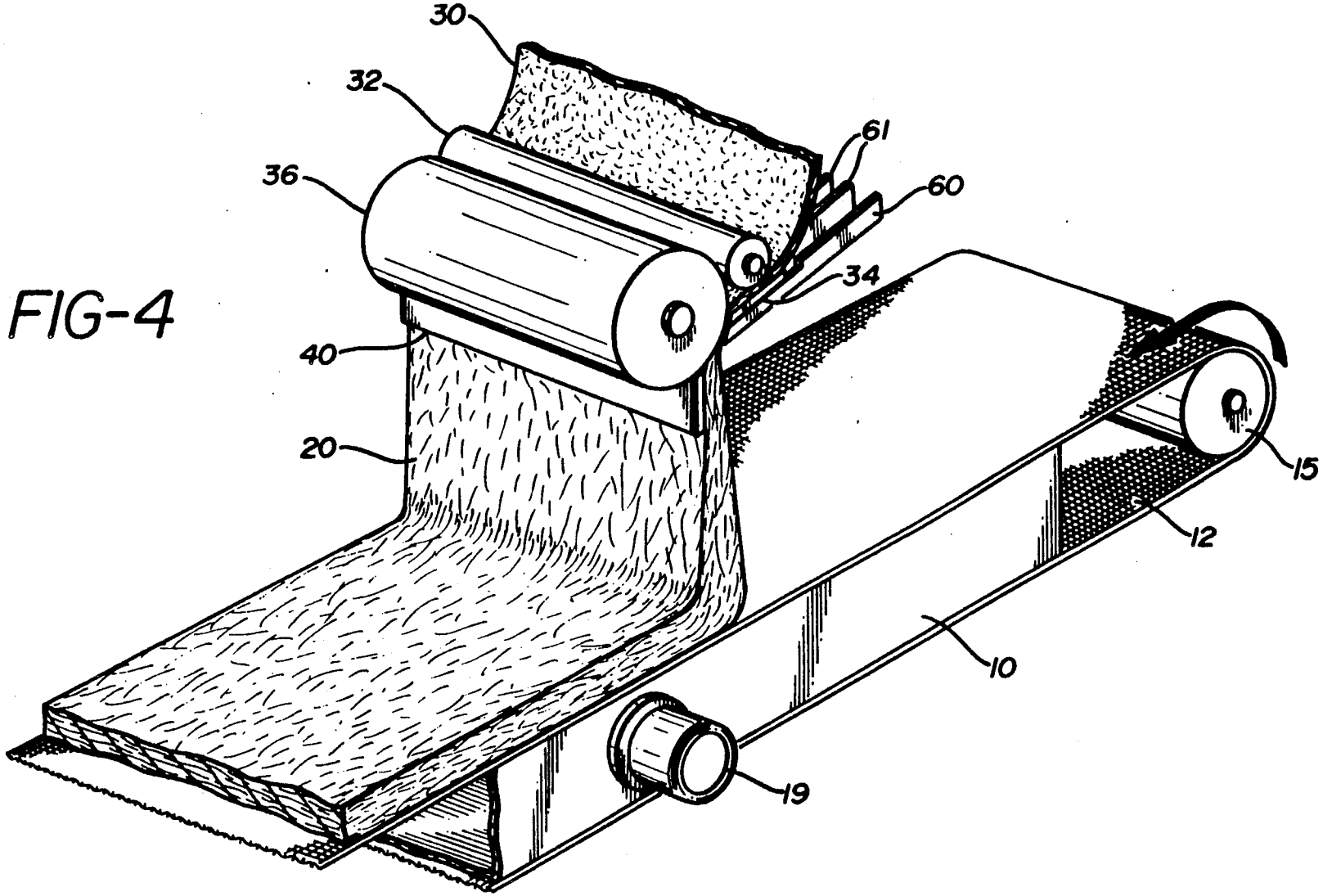
FIG. 4 is a perspective view of the apparatus of FIG. 1 equipped with a feed tray.

As shown in FIG. 4, the tray may have longitudinal dividers 61 within it. Different particulate material may be located in each section of the tray formed by the dividers. These different materials will tend to be drawn to the portion of the lickerin immediately in front of the portion of the tray where they are located and then deflected to the corresponding portion of the forming web. If materials A, B, and C are spaced evenly in the tray, this material will be blended in the web product as shown in FIG. 3. The difference from the prior description of FIG. 3, however, is that the pulp fibers will be uniform and the variation in material will be in the concentration of particles mixed with the pulp.

Figure 5:
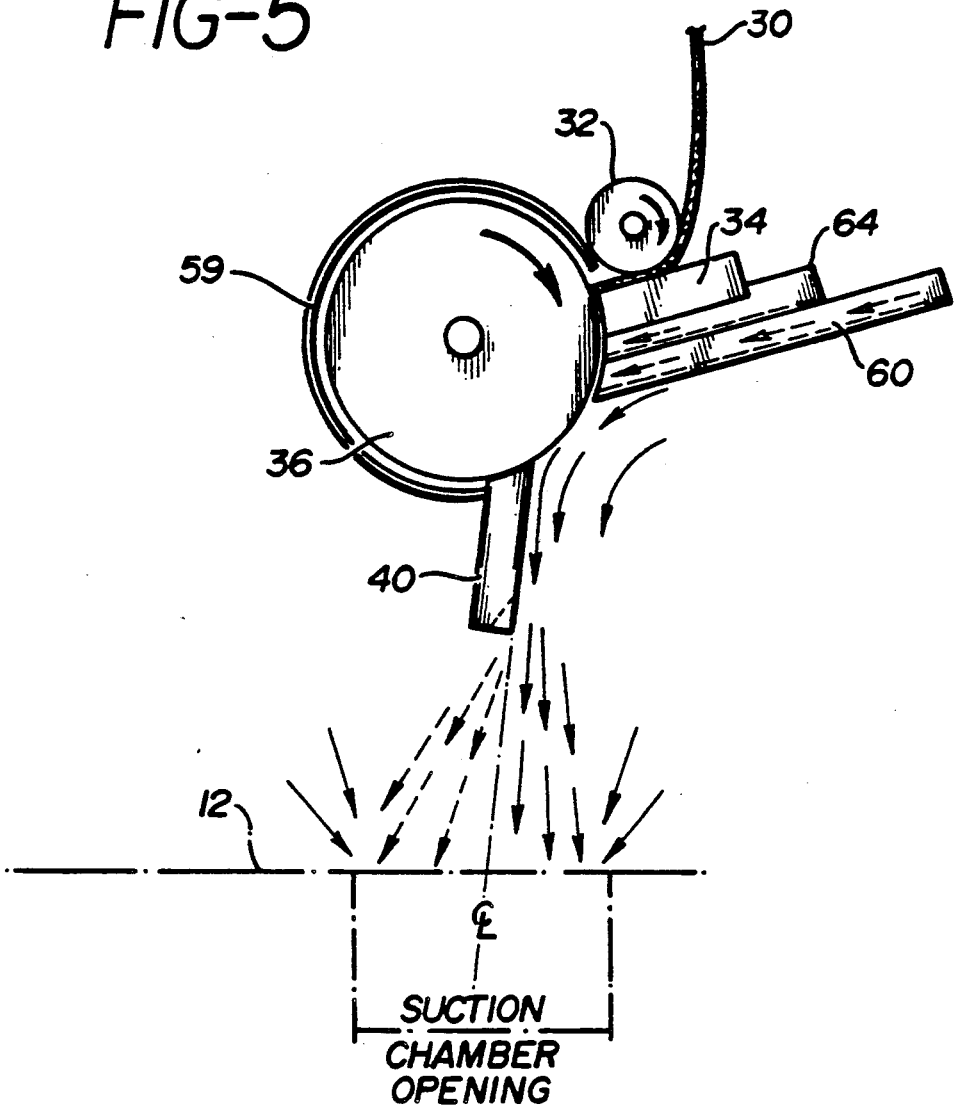
FIG. 5 is a side sectional view of the apparatus of FIG. 4 showing two feed trays and the effect of angling the deflector plate.

Instead of a single feed tray, one or more additional trays may also be used. As shown in FIG. 5, a second tray 64 is located above the first tray 60 and supplies an additional source of particulate matter to the fiber stream. As with tray 60, tray 64 may have a number of dividers with different types of particulate materials in each section of the tray. These materials in tray 64 will not only blend with the short fibers, but will also blend with the particulate matter in tray 60 which is adjacent the same section of the lickerin. As a result, strips of uniquely blended combinations of two or more particles and short fibers can be formed along the continuously forming fiber structure.

Figure 6A:
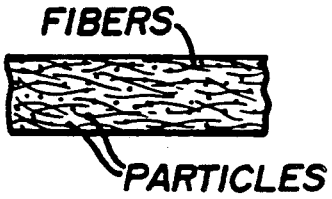
FIG. 6A and 6B are cross section views of products made by the apparatus of FIG. 5.
Figure 6B:
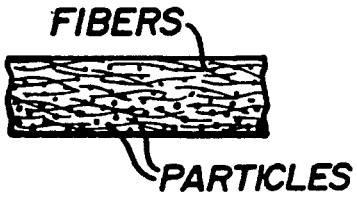

Generally, the deflector plate 40 is straight and the fiber stream is directed straight down on to the conveyor as shown by the solid arrows in FIG. 5. This results in a uniform blend of short fibers and particles as shown in FIG. 6A. However, if the edge of the deflector adjacent the fiber stream is angled (as shown in dotted line) or given a radius curve, light particles, e.g. pulp fibers, will follow the curve or angle of the deflector plate due to the wall attachment or Coanda effect. Thus, these fibers are deposited at a different angle as shown by the dashed arrows in FIG. 5. The heavy particles, e.g. thermoplastic bonding particles, will continue in the straight line under the influence of inertia. The angled deflector plate results in the heavy particles being laid down mainly toward the bottom of the web and the light particles toward the top of the web as shown in FIG. 6B.

In one example of the present invention, individual pulp fibers can be generated by the lickerin by engagement with the pulp fiber board. Superabsorbent powder can be drawn to the lickerin from the first feed tray and thermoplastic bonding particles (e.g. polyethylene granules) from the second tray. Depending on the type of deflector, these particles can be uniformly blended or laid down in layers predominated by one of these materials. Subsequently, the web can be heated so the fiber and superabsorbent particles are stabilized by the thermo-bonding material and retain their position in the structure.

While the invention has been particularly shown and described with reference to a preferred embodiment thereof, it will be understood by those skilled in the art, that various changes in form and details may be made therein without departing from the spirit and scope of the invention.

What is claimed is:

1. A method of forming a non-woven web of fibers comprising the steps of:

feeding a source of fiber stock into engagement with a rotating toothed cylinder;

rotating the cylinder at such a speed that the stock is opened so as to form individual fibers moving with the cylinder in induced air stream;

deflecting the individual fibers from the cylinder in the form of a stream of fibers by positioning one end of a deflector plate adjacent to the peripheral surface of the cylinder and another remote end away from the cylinder, so a guiding surface of the deflector plate guides the fibers from the cylinder;

keeping the cylinder free of air streams other than said induced air streams which would tend to doff the fibers from the cylinder;

keeping the stream of fibers free of confining ducts; and intercepting the stream of fibers with a moving conveyor and accumulating the fibers on the conveyor to form a web material.

2. The method as claimed in claim 1, wherein the step of feeding involved simultaneously feeding two different laterally spaced stocks to the cylinder.

3. The method as claimed in claim 1, further including the step of protecting the peripheral surface of the cylinder with a cover extending from the deflector plate to the feed means on the side of the cylinder opposite the fiber stream.

4. The method as claimed in claim 1, further including the step of creating a vacuum of less than 5 inches of water through perforations in the conveyor.

5. The method as claimed in claim 1, further including the step of providing a porous substrate on the moving conveyor prior to intercepting the stream of fibers with the conveyor, such that the web of material is formed on the substrate.

6. The method as claimed in claim 1, further including the step of locating at least one open tray of particulate material adjacent the cylinder so that the material is drawn to the cylinder due to its rotation and is blended with the fibers for deflection by the deflector plate.

7. The method as claimed in claim 6, further including the step of providing a taper to the deflector plate away from the guiding surface at the remote end of the plate such that the fibers and the particulate material are deflected at different angles.

8. A uniform fluff web product produced by the method of claim 1, having a length, width and thickness wherein the web is substantially free of shingle effect.

9. The product as claimed in claim 8, wherein the fibers of one lateral portion of the web differ from the fibers of another lateral portin.

10. The product as claimed in claim 8, wherein at least one type of particulate material is uniformly blended in the product.

11. The product as claimed in claim 8, wherein different particulate materials are blended with fibers at different lateral portions of the web.

12. The product as claimed in claim 8, wherein the particulate material predominates at one level of thickness of the web.

* * * * *

UNITED STATES PATENT AND TRADEMARK OFFICE

CERTIFICATE OF CORRECTION

PATENT NO. : 5,093,962

DATED : March 10, 1992

INVENTOR(S) : Farrington et al.

It is certified that error appears in the above-identified patent and that said Letters Patent is hereby corrected as shown below:

Claim 1, column 7, line 28, "stream" should be -- streams --; and

Claim 9, column 8, line 32, "portin" should be -- portion --.

Signed and Sealed this

Twenty-eighth Day of September, 1993

*Attest:*

*Attesting Officer*

BRUCE LEHMAN

*Commissioner of Patents and Trademarks*